US011681253B2

(12) United States Patent
Kyotani

(10) Patent No.: US 11,681,253 B2
(45) Date of Patent: Jun. 20, 2023

(54) IMAGE FORMING APPARATUS REWRITING USAGE STATUS INFORMATION TO INFORMATION INDICATING THAT CARTRIDGE IS OLD CARTRIDGE

(71) Applicant: BROTHER KOGYO KABUSHIKI KAISHA, Nagoya (JP)

(72) Inventor: Tadao Kyotani, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/196,202

(22) Filed: Mar. 9, 2021

(65) Prior Publication Data

US 2021/0302889 A1 Sep. 30, 2021

(30) Foreign Application Priority Data

Mar. 30, 2020 (JP) ..... JP2020-061156

(51) Int. Cl.

*G03G 21/18* (2006.01)
*G03G 15/00* (2006.01)
*G03G 15/08* (2006.01)

(52) U.S. Cl.

CPC ..... *G03G 15/553* (2013.01); *G03G 15/0863* (2013.01); *G03G 21/1875* (2013.01); *G03G 21/1878* (2013.01); *G03G 21/1889* (2013.01); *G03G 21/1892* (2013.01); *G03G 2221/1823* (2013.01)

(58) Field of Classification Search

CPC ..... G03G 15/553; G03G 15/5075; G03G 15/5079; G03G 15/0863; G03G 21/1875; G03G 21/1878; G03G 21/1882; G03G 21/1889; G03G 21/1892; G03G 2221/0695; G03G 2221/0697; G03G 2221/1823

See application file for complete search history.

(56) References Cited

U.S. PATENT DOCUMENTS

2004/0207865 A1 10/2004 Wachter et al.
2006/0034625 A1* 2/2006 Kajikawa ..... G03G 21/181 399/12
2006/0127105 A1* 6/2006 Lee ..... G03G 15/556 399/12
2017/0230540 A1* 8/2017 Sasaki ..... H04N 1/00538

* cited by examiner

*Primary Examiner* — Arlene Heredia
*Assistant Examiner* — Laura Roth
(74) *Attorney, Agent, or Firm* — Merchant & Gould P.C.

(57) ABSTRACT

An image forming apparatus includes a main casing and a controller. A cartridge is to be attached to the main casing. The cartridge includes a memory stores usage status information indicating whether the cartridge is a new cartridge or an old cartridge which indicates a used product. The controller reads the usage status information stored in the memory in a case that attachment of the cartridge to the main casing is detected. The controller determines, based on the usage status information, whether the cartridge is the new cartridge or the old cartridge. The controller rewrites the usage status information to information indicating that the cartridge is the old cartridge in a case that the cartridge is determined to be the new cartridge. The rewriting is performed before the controller receives a print instruction and before the material or the part of the cartridge is consumed.

5 Claims, 4 Drawing Sheets

IMAGE FORMING APPARATUS REWRITING USAGE STATUS INFORMATION TO INFORMATION INDICATING THAT CARTRIDGE IS OLD CARTRIDGE

CROSS REFERENCE TO RELATED APPLICATION

This application claims priority from Japanese Patent Application No. 2020-061156 dated Mar. 30, 2020. The entire content of the priority application is incorporated herein by reference.

TECHNICAL FIELD

The present disclosure is related to an image forming apparatus, a controlling method, and a cartridge.

BACKGROUND

An image forming apparatus such as a printer uses a cartridge to perform image formation. The cartridge accommodates ink or toner. The ink or toner is consumed each time image formation is performed. An ink cartridge or a toner cartridge needs to be replaced in a case that no ink or no toner remains therein.

In a conventional image forming apparatus, in a case that a new cartridge is attached to the image forming apparatus, a controller of the image forming apparatus starts monitoring occurrence of a trigger event. In a case that the trigger event occurs, the controller rewrites data stored in a memory of the cartridge attached to the image forming apparatus so that the rewritten data indicates that the cartridge is in a state of a used product. Here, the trigger event is an event indicating that the cartridge is to be used or the cartridge was used.

SUMMARY

Meanwhile, there is a need for an image forming apparatus capable of recognizing such a change in cartridge status from a new cartridge to an old cartridge, not at a timing at which the new cartridge is actually used, but at a timing at which the new cartridge is attached to the image forming apparatus.

It is an object of the present disclosure to provide an image forming apparatus to rewrite usage status information stored in a memory of an attached new cartridge to an old cartridge at a timing at which the new cartridge is attached to the image forming apparatus.

In order to attain the above and other objects, the disclosure provides an image forming apparatus. The image forming apparatus includes a main casing, a cover, and a controller. The main casing has an opening through which a cartridge is to be attached. The cartridge includes material or part to be used for performing image formation. The cartridge further includes a first memory configured to store usage status information indicating whether the cartridge is a new cartridge or an old cartridge which indicates a used product. The cover is movable between a first position at which the opening is opened and a close position at which the opening is closed. The controller is configured to perform a process related to the image formation, the controller being configured to perform: an attachment detection process to detect that the cartridge is attached to the main casing; a reading process to read the usage status information stored in the first memory of the cartridge attached to the main casing in a case that attachment of the cartridge to the main casing is detected in the attachment detection process; a determination process to determine, based on the usage status information read in the reading process, whether the cartridge attached to the main casing is the new cartridge or the old cartridge; and a rewriting process to rewrite the usage status information to information indicating that the cartridge is the old cartridge in a case that the cartridge attached to the casing is determined to be the new cartridge in the determination process. The rewriting process is performed before the controller receives a print instruction and before the material or the part of the cartridge is consumed.

According to another aspect, the disclosure provides a controlling method for controlling an image forming apparatus. The controlling method includes: a reading step to read, in response to attachment of a cartridge including material or part to be used for performing image formation to a main casing of the image forming apparatus, the usage status information stored in the first memory of the cartridge attached to the main casing, the usage status information indicating whether the cartridge is a new cartridge or an old cartridge which indicates a used product; a determination step to determine, based on the usage status information read in the reading process, whether the cartridge attached to the main casing is the new cartridge or the old cartridge; and a rewriting step to rewrite the usage status information to information indicating that the cartridge is the old cartridge in a case that the cartridge attached to the casing is determined to be the new cartridge in the determination step. The rewriting step is performed before the image forming apparatus receives a print instruction and before the material or the part of the cartridge is consumed.

According to still another aspect, the disclosure provides a cartridge. The cartridge includes a cartridge casing, and a first memory. The cartridge casing includes the cartridge including material or part to be used for performing image formation. The first memory is configured to store usage status information indicating whether the cartridge is a new cartridge or an old cartridge which indicates a used product. The usage status information is rewritable to information indicating that the cartridge is the old cartridge in response to an attachment of the cartridge. The usage status information is rewritable before a print instruction using of the cartridge is executed and before the material of the part of the cartridge is consumed.

BRIEF DESCRIPTION OF THE DRAWINGS

The particular features and advantages of the disclosure as well as other objects will become apparent from the following description taken in connection with the accompanying drawings, in which.

DETAILED DESCRIPTION

First Embodiment

An embodiment of a present disclosure will be described while referring to drawings FIGS. 1-4. In the present embodiment, a case that the image forming apparatus is a laser printer will be described as an example. However, the image forming apparatus 1 may be printers other than the laser printer. For example, the image forming apparatus 1 may be an inkjet printer.

Figure 1:
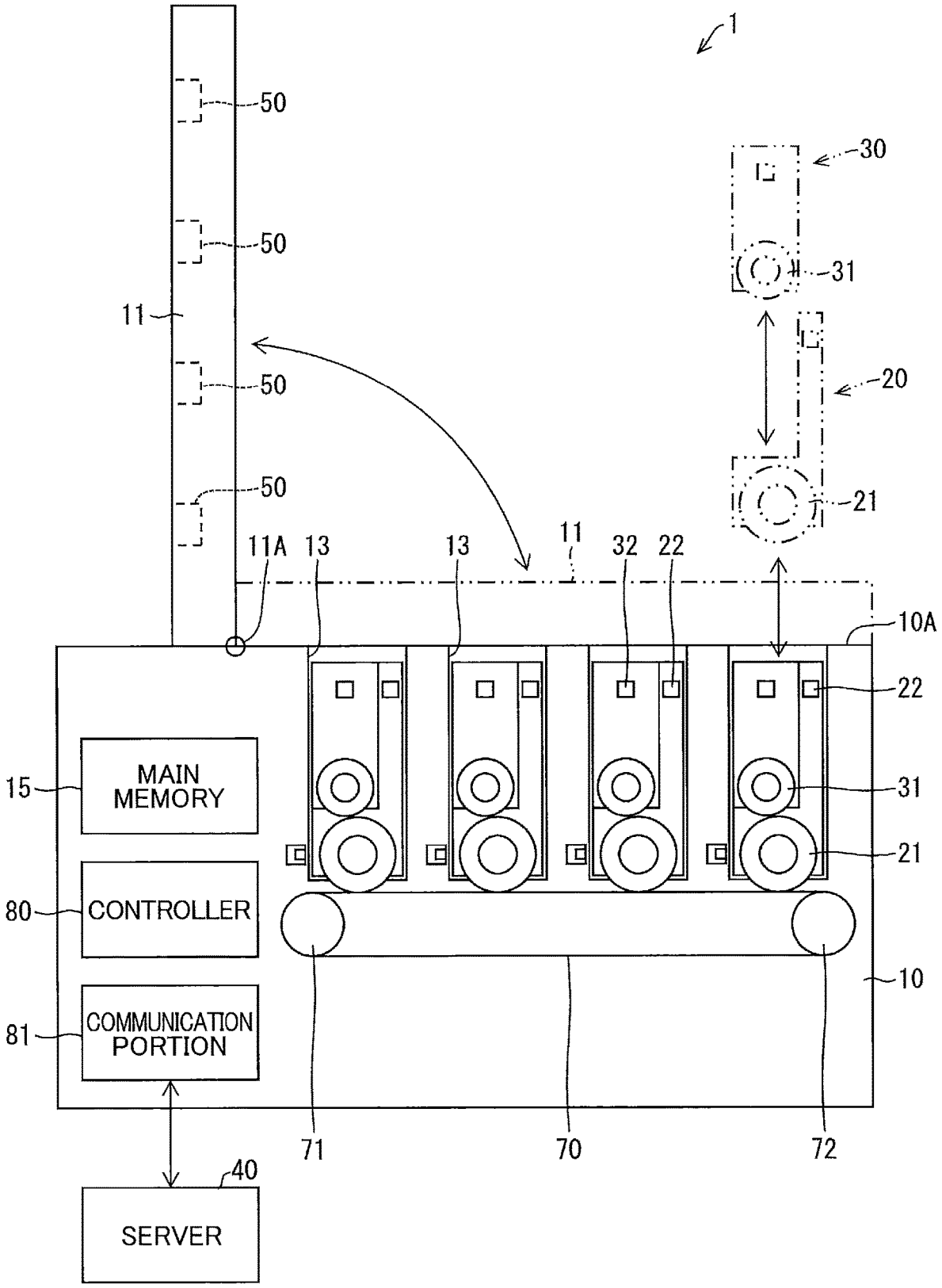
FIG. 1 is a schematic diagram illustrating an image forming apparatus according to an embodiment.
Figure 2:
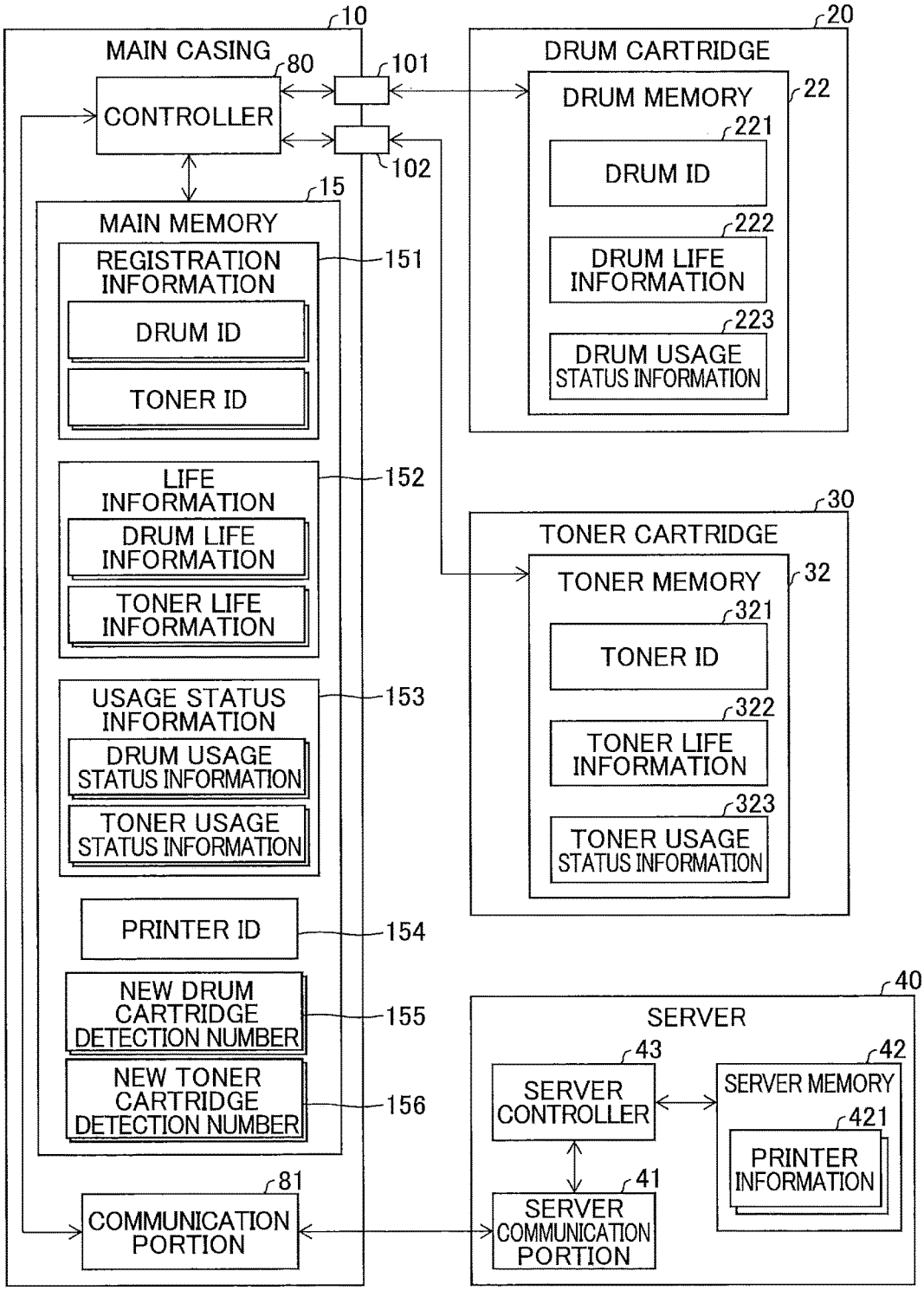
FIG. 2 is a diagram illustrating internal structures of the image forming apparatus, a drum cartridge, a toner cartridge, and a server, and connection relation of components therein.

FIG. 1 is a schematic diagram illustrating the image forming apparatus 1. FIG. 1 also shows a server 40 that communicates with the image forming apparatus 1. FIG. 2 is a diagram illustrating internal structures of the image forming apparatus 1, a drum cartridge 20, a toner cartridge 30, and the server 40, and connection relation among components therein.

Overview of Structures of the Image Forming Apparatus

The image forming apparatus 1 is a printer of an electrophotographic method. For example, the image forming apparatus 1 may be an LED printer.

As shown in FIGS. 1 and 2, the image forming apparatus 1 includes a main casing 10, a cover 11, a transfer belt 70, and a controller 80. Drum cartridges 20 as examples of a cartridge, and toner cartridges 30 as examples of the cartridge are configured to be attached to the image forming apparatus 1.

In the image forming apparatus of the present embodiment, four drum cartridges 20 and four toner cartridges are required to be attached for performing image formation. However, the number of the drum cartridges 20 and the number of the toner cartridges 30 are not limited to these.

The image forming apparatus 1 includes light source units corresponding to respective the drum cartridges 20. That is, the image forming apparatus 1 includes the four light source units 50. The toner cartridge 30 is integrated with the drum cartridge 20 when the toner cartridge 30 is attached to the drum cartridge 20. In a state that the toner cartridge 30 is attached to the drum cartridge 20, the toner cartridge 30 together with the drum cartridge 20 is attached to the main casing 10.

The main casing 10 has a rectangular box shape, for example. The four drum cartridges 20, the four toner cartridges 30, the transfer belt 70, and the controller 80 are accommodated in the main casing 10. The main casing 10 includes four cartridge holders 13. Each cartridge holder 13 is formed with a concave shape and having an opening. The drum cartridges 20 and the toner cartridges 30 are attached to the main casing 10 by being held by the respective cartridge holders 13.

A display portion and an input portion may be provided on an outer surface of the main casing 10. The display portion includes a liquid-crystal display and a lamp. The input portion includes a button. The liquid-crystal display may be integrally formed with a touch panel to function as the input portion.

The cover 11 opens and closes an opening 10A formed in an upper end of the main casing 10. As illustrated in FIG. 1, the cover 11 is pivotally movable (movable) about a rotation axis 11A extending in a first direction between an open position indicated by a solid line and a close position indicated by a two-dot chain line. The "first direction" refers to a direction in which a rotation center axis (developing axis) of a developing roller 31 in the toner cartridge 30 extends. In a case that the cover 11 is positioned at the open position, the openings of the cartridge holders 13 are opened. In a case that the cover 11 is positioned at the close position, the openings of the cartridge holders 13 are covered by the cover 11.

The opening 10A includes a closing sensor (not shown). The closing sensor can detect that the cover 11 is at the close position. The closing sensor may be a contact-type sensor or an optical-type sensor, for example.

Drum Cartridges

Each drum cartridges 20 includes a cartridge casing. Each cartridge casing is attachable to the main casing 10 and includes a photosensitive drum 21 as a component used for image formation. Each photosensitive drum 21 is a replaceable component and need to be replaced when a surface of the photosensitive drum 21 deteriorates due to wear with use. Each photosensitive drum 21 is a cylindrical photoreceptor extending in the first direction and rotatable about a drum axis extending in the first direction. An outer circumferential surface of each photosensitive drum 21 is coated with a photosensitive material.

Each drum cartridge 20 includes a drum memory 22 as an example of a first memory. The drum memory 22 is a readable and writable memory. The drum memory 22 is, for example, a flash ROM (Read Only Memory) or an EEPROM (Electronically Erasable and Programmable Read Only Memory, registered trademark).

The drum memory 22 includes a first region 221, a second region 222, and a third region 223 to store information related to the photosensitive drum 21 of the corresponding drum cartridge 20. The first region 221 stores a drum ID. The second region 222 stores drum life information. The third region 223 stores drum usage status information as an example of usage status information.

The drum ID is a unique serial number assigned to identify the individual drum cartridge 20. The drum life information indicates the life of the photosensitive drum 21. For example, the drum life information includes at least one of the cumulative number of rotations of the photosensitive drum 21 and the cumulative number of sheets printed using the photosensitive drum 21. The drum cartridge 20 identified by the drum ID calculates the cumulative number of rotations of the photosensitive drum 21 by incrementing or decrementing the cumulative number of rotations of the photosensitive drum 21 each time printing is performed. The drum cartridge 20 identified by the drum ID calculates the cumulative number of sheets printed using the photosensitive drum 21 by incrementing or decrementing the cumulative number of sheets printed using the photosensitive drum 21 each time printing is performed.

The drum usage status information indicates whether the drum cartridge 20 is a new cartridge or an old cartridge indicating a used product. In the present embodiment, the "used product" indicates a product that is not new or that is not unused. In other words, the "used product" indicates not only a drum cartridge 20 that is used up to the end of the life of the photosensitive drum 21, but also a drum cartridge 20 that is not a new cartridge and is still in use with the life of the photosensitive drum 21 remaining.

In addition to the drum ID, the drum life information, and the drum usage status information, the drum memory 22 may also store a conforming model of the drum cartridge 20, specification of the drum cartridge 20, information indicating whether the drum cartridge 20 is genuine, and an error history of the drum cartridge 20.

Toner Cartridges

Each toner cartridges 30 includes a developing roller 31 and a cartridge casing. Each cartridge casing is attachable to the main casing 10 and can accommodate a developer such as toner. The toner is an example of a printing material. The toner cartridges 30 accommodate developers of different colors (e.g., cyan, magenta, yellow, and black) as materials used for image formation. The developer is a consumable that runs out with use. Each developing roller 31 is a cylindrical member extending in the first direction and rotatable about the developing axis extending in the first direction. In a case that the toner cartridge 30 is attached to the corresponding drum cartridge 20, an outer circumferential surface of the developing roller 31 contacts the outer circumferential surface of the corresponding photosensitive drum 21.

Each toner cartridge 30 includes a toner memory 32 as an example of the first memory. The toner memory 32 is provided at an outer surface on one side of the toner cartridge 30 in the first direction. The toner memory 32 is a readable and writable memory such as a flash ROM or an EEPROM (registered trademark).

The toner memory 32 includes a first region 321, a second region 322, and a third region 323 to store information related to the corresponding toner cartridge 30. The first region 321 stores a toner ID. The second region 322 stores toner life information. The second region 322 may store rewritable data. The third region 323 stores toner usage status information as an example of the usage status information.

The toner ID is a unique serial number to identify the individual toner cartridge 30, for example. The toner life information indicates the life of the developing roller 31. For example, the toner life information includes at least one of the cumulative number of rotations of the developing roller 31, the cumulative number of sheets printed using the developing roller 31, and the cumulative number of dots formed using the developing roller 31.

The toner cartridge 30 identified by the toner ID calculates the cumulative number of rotations of the developing roller 31 by incrementing or decrementing the cumulative number of rotations of the developing roller 31 each time printing is performed. The toner cartridge 30 identified by the toner ID calculates the cumulative number of sheets printed using the developing roller 31 by incrementing or decrementing the cumulative number of sheets printed using the developing roller 31 each time printing is performed. The toner cartridge 30 identified by the toner ID calculates the cumulative number of dots formed using the developing roller 31 by incrementing or decrementing the cumulative number of dots formed using the developing roller 31 each time printing is performed.

The toner usage status information indicates whether the toner cartridge 30 is a new cartridge or an old cartridge indicating a used product. As with the drum usage status information, the "used toner cartridge" includes any toner cartridge 30 that is not new and is still in use with the life of the developing roller 31 remaining.

Cartridge Attachment and Printing Mechanism

As illustrated in FIG. 1, in a state that the cover 11 is positioned at the open position, the drum cartridges 20 and the toner cartridges 30 are attached to the main casing 10. In this state, the drum cartridges 20 and the toner cartridges 30 are inserted into the respective cartridge holders 13 through the opening 10A.

The main casing 10 includes connectors 101 and 102. In a state that the drum cartridges 20 are inserted into the respective cartridge holders 13, the connectors 101 are electrically connected to the respective drum memories 22, and the controller 80 of the main casing 10 can communicate with the drum memories 22 of the drum cartridges 20.

In a state that the toner cartridges 30 are attached to the main casing 10, the connectors 102 are electrically connected to the respective toner memories 32, and the controller 80 can communicate with the toner memories 32 of the toner cartridges 30.

The four light source units 50 are attached to an inner surface of the cover 11. In a state that the drum cartridges 20 are attached to the main casing 10 and the cover 11 is positioned at the close position, the light source units 50 face the surfaces of the respective photosensitive drums 21. Each light source unit 50 includes a plurality of light sources arranged in the first direction. Each light source unit 50 can irradiate the outer circumferential surface of the corresponding photosensitive drum 21 with light. The light sources are LEDs (Light Emitting Diodes), for example.

The light source units 50 are electrically connected to the controller 80. The controller 80 controls the light sources to irradiate the outer circumferential surfaces of the respective photosensitive drums 21 with light based on received image data. As a result, the photosensitive materials on the outer circumferential surfaces of the photosensitive drums 21 are exposed to light based on the image data.

The transfer belt 70 transfers the developers (e.g., toner) on the outer circumferential surfaces of the photosensitive drums 21 to a printing sheet. The transfer belt 70 is a replaceable component which needs to be replaced because surfaces of the transfer belt 70 deteriorate due to wear with use. An outer circumferential surface of the transfer belt 70 can contact the outer circumferential surfaces of the photosensitive drums 21. The transfer belt 70 is a ring-shaped endless belt. When printing, a printing sheet is transferred between the transfer belt 70 and the photosensitive drums 21.

The transfer belt 70 is stretched between a drive roller 71 and a driven roller 72. The drive roller 71 drives the transfer belt 70. The controller 80 rotates the drive roller 71. As the transfer belt 70 moves according to the driving of the drive roller 71, the driven roller 72 rotates by following the transfer belt 70.

Internal Structure of Main Casing

The controller 80 includes an ASIC (Application Specific Integrated Circuit), for example. The controller 80 is electrically connected to a main memory 15 and a communication portion 81, which are included in the main casing 10. The main memory 15 is an example of a second memory. The controller 80 performs various processes, causing the image forming apparatus 1 to perform a printing process and other processes associated with the printing process.

The controller 80 may include a processor such as a CPU. In this case, a control program for executing an image formation control method may be stored in the main memory 15, and by operation of the processor according to the control program, the controller 80 may cause the image forming apparatus 1 to perform the printing process.

The controller 80 may also include a computer-readable storage medium storing the control program. As the storage medium, the controller 80 may include a "non-transitory tangible medium" such as a ROM (Read Only Memory), a tape, a disk, a card, a semiconductor memory, or a programmable logic circuit. The controller 80 may also include a RAM (Random Access Memory) to expand the control program therein. The control program may be supplied to the computer via any transmission medium (e.g., a communication network or a broadcast wave) capable of transmitting the control program. An aspect of the present disclosure may be implemented in the form of a data signal embedded in a carrier wave, through which the control program is embodied according to electrical transmission.

As illustrated in FIG. 2, in a case that the drum cartridge 20 and the toner cartridge 30 are attached to the corresponding cartridge holder 13, the drum memory 22 and the toner memory 32 are electrically connected to the controller 80. Accordingly, the controller 80 can perform a reading process to read information from the drum memory 22 and the toner memory 32 and a writing process (including a rewriting process) to write information to the drum memory 22 and the toner memory 32.

The main memory 15 is a readable and writable memory. The main memory 15 is a flash ROM or an EEPROM (registered trademark), for example. The main memory 15 includes a region 151, a region 152, and a region 153. The region 151 stores registration information. The region 152 stores life information. The region 153 stores usage status information.

The registration information includes the drum ID read from the drum memory 22 and the toner ID read from the toner memory 32.

The life information includes drum life information and toner life information. As with the drum life information stored in the drum memory 22, the drum life information includes at least one of the cumulative number of rotations of the photosensitive drum 21 and the cumulative number of sheets printed using the photosensitive drum 21, for example. As with the toner life information stored in the toner memory 32, the toner life information includes at least one of the cumulative number of rotations of the developing roller 31, the cumulative number of sheets printed using the developing roller 31, and the cumulative number of dots formed using the developing roller 31, for example.

The usage status information includes drum usage status information and toner usage status information. As with the drum usage status information stored in the drum cartridge 20, the drum usage status information indicates whether the drum cartridge 20 is a new cartridge or an old cartridge. As with the toner usage status information stored in the toner cartridge 30, the toner usage status information indicates whether the toner cartridge 30 is a new cartridge or an old cartridge.

The main memory 15 may also include a region 154 to store a printer ID. The printer ID is identification information for identifying the image forming apparatus 1. The printer ID is a serial number of the image forming apparatus 1, for example.

The main memory 15 may also include a region 155 and a region 156. The region 155 stores a new drum cartridge detection number. The region 156 stores a new toner cartridge detection number. The new drum cartridge detection number indicates the number of times a new drum cartridge 20 is attached to the main casing 10. The new toner cartridge detection number indicates the number of times a new toner cartridge 30 is attached to the main casing 10.

The main memory 15 may store, for each cartridge holder 13, the number of times a new drum cartridge 20 is attached to the cartridge holder 13, as a new drum cartridge detection number. Alternatively, the main memory 15 may store, as a new drum cartridge detection number, a sum of numbers of times new drum cartridges 20 are attached to the four cartridge holders 13.

The main memory 15 may store, for each cartridge holder 13, the number of times a new toner cartridge 30 is attached to the cartridge holder 13, as a new toner cartridge detection numbers. Alternatively, the main memory 15 may store, as a new toner cartridge detection number, a sum of numbers of times new toner cartridges 30 are attached to the four cartridge holders 13.

The communication portion 81 is a communication interface performing communication between the image forming apparatus 1 and the server 40. The communication portion 81 outputs a request received from the server 40 to the controller 80. The "request" is a request to require the image forming apparatus 1 to transmit status data. The communication portion 81 transmits the status data received from the controller 80 to the server 40. The "status data" is data related to the operation status of the image forming apparatus 1 and including at least identification information of the printer and the new cartridge detection number. In the present embodiment, the status data includes at least one of the printer ID, the new drum cartridge detection number, and the new toner cartridge detection number. The status data may also include the cumulative number of sheets printed in the image forming apparatus 1 and the number of sheets printed since the replacement of each cartridge in the image forming apparatus 1.

Server

The server 40 is a management apparatus to manage the operation status of the image forming apparatus 1. The server 40 includes a server communication portion 41, a server memory 42, and a server controller 43. The server communication portion 41 is a communication interface performing communication between the server 40 and the image forming apparatus 1. The server communication portion 41 transmits a request received from the server controller 43 to the image forming apparatus 1. The server communication portion 41 receives status data transmitted from the image forming apparatus 1 in response to the transmitted request, and outputs the status data to the server controller 43.

The server controller 43 includes a CPU (Central Processing Unit) and integrally controls the server 40. At a predetermined timing, the server controller 43 generates a request for require the image forming apparatus 1 to transmit status data, and outputs the generated request to the server communication portion 41.

The server controller 43 controls the server memory 42 to store the status data received via the server communication portion 41. Specifically, the server controller 43 controls the server memory 42 to store the received status data as printer information of the image forming apparatus 1 that is a transmission source of the status data.

The server memory 42 is a storage device for storing data necessary for the operation of the server 40. The server memory 42 includes a region 421 storing printer information. The printer information is data summarizing various types of information related to the image forming apparatus 1. The printer information is stored separately for each image forming apparatus 1. The printer information includes at least the printer ID and the status data. The printer information may also include a model number of the image forming apparatus 1, the date, month, and year of manufacture of the image forming apparatus 1, and information indicating whether the image forming apparatus 1 is signed up for a subscription, for example.

Processing Flow of Image Forming Apparatus

Figure 3:
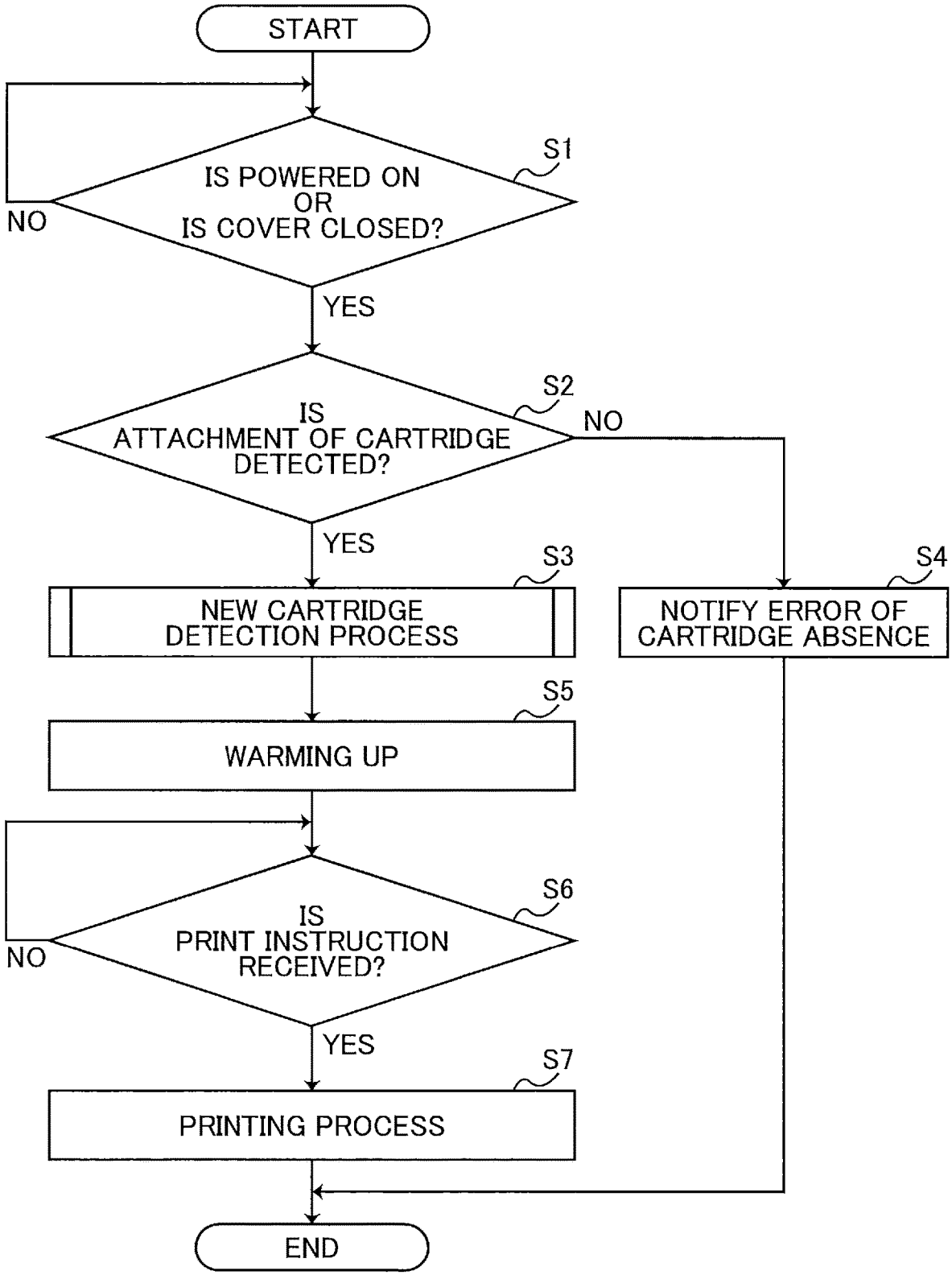
FIG. 3 is a flowchart illustrating examples of steps a process executed by a controller in the image forming apparatus.

FIG. 3 is a flowchart illustrating an example of a processing flow in the image forming apparatus 1. Hereinafter, the drum cartridges 20 and the toner cartridges 30 will be collectively referred to as "cartridges".

The controller 80 uses an event that the image forming apparatus 1 is in power on state or an event that the cover 11 is closed (S1: YES) as a trigger to start an attachment detection process to detect whether the cartridges are attached to the main casing 10. There is no particular limitation on how the attachment detection process is performed. For example, each cartridge holder 13 may be provided with a sensor for detecting the attachment of the cartridge. In a case that the sensors for detecting the attachment of the cartridge are provided, the controller 80 may receive a detection result from each sensor so that the controller 80 can detect that the corresponding cartridge is attached to the main casing 10. Alternatively, the controller 80 may detect that the cartridge is attached to the main casing 10 in response to an electric connection between the controller 80 and the toner memory 32 or the drum memory 22. In a case that the controller 80 detects that the cartridges are attached to the main casing 10 (S2: YES), in S3 the controller 80 performs a new cartridge detection process. In a case that the controller 80 does not detect that the cartridges are attached to the main casing 10 (S2: NO), in S4 the controller 80 notifies the user of the absence of the cartridges as an error. For example, the controller 80 may notify the user of this error by displaying a message on the display of the image forming apparatus 1.

New Cartridge Detection Process

Figure 4:
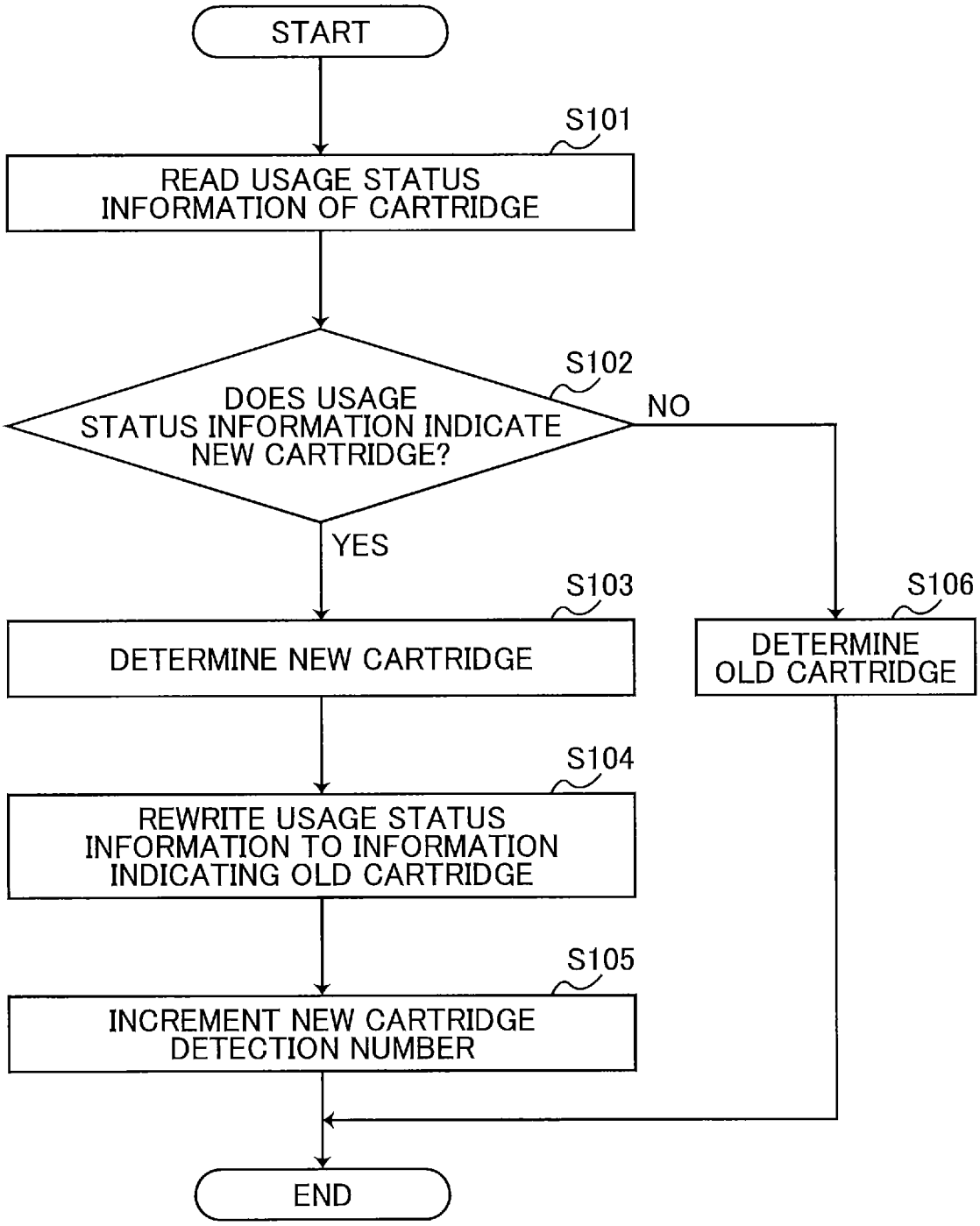
FIG. 4 is a flowchart illustrating examples of steps of a new cartridge detection process executed by the controller.

FIG. 4 is a flowchart illustrating an example of a flow of the new cartridge detection process. In the new cartridge detection process, in S101 the controller 80 performs a read process to read the usage status information stored in the memory of each cartridge attached to the main casing 10. In the present embodiment, the controller 80 reads the drum usage status information stored in each drum memory 22. In addition, the controller 80 reads the toner usage status information stored in each toner memory 32.

In S102, S103, and S106, the controller 80 performs a determination process to determine whether each cartridge is a new cartridge or an old cartridge based on the read usage status information. All the processes from S102 are performed for each usage status information, i.e., for each cartridge. Specifically, in S102, the controller 80 determines whether the usage status information of each cartridge indicates a new cartridge. In the present embodiment, the controller 80 determines whether the drum usage status information of each of the four drum cartridges 20 indicates a new cartridge. The controller 80 also determines whether the toner usage status information of each of the four toner cartridges 30 indicates a new cartridge or not.

In a case that the usage status information does not indicate a new cartridge (S102; NO), in S106 the controller 80 determines that the cartridge corresponding to the usage status information is an old cartridge. Then, the controller 80 ends the new cartridge detection process. In a case that the usage status information indicates a new cartridge (S102: YES), in S103 the controller 80 determines that the cartridge corresponding to the usage status information is a new cartridge.

In a case that the controller 80 determines that the cartridge is a new cartridge, in S104 the controller 80 performs a rewrite process. In the rewrite process, the controller 80 rewrites the usage status information of the cartridge determined to indicate a new cartridge to information indicating that the cartridge is an old cartridge. After the rewrite process, in S105 the controller 80 performs an update process to increment the new cartridge detection number stored in the main memory 15. In a case that the cartridge determined to be a new cartridge is the drum cartridge 20, in the update process the controller 80 increments the new drum cartridge detection number by one. In a case that the cartridge determined to be a new cartridge is the toner cartridge 30, the controller 80 increments the new toner cartridge detection number by one. Accordingly, when the new cartridge detection process is completed for all the cartridges, the new drum cartridge detection number is incremented by the number of times the new drum cartridge is detected and the new toner cartridge detection number is incremented by the number of times the new toner cartridge is detected. In a case that the image forming apparatus 1 has the specification not to transmit the new cartridge detection number to the server 40, the controller 80 may omit the process of S105.

Referring back to FIG. 3, in a case that the new cartridge detection process of S3 is completed, in S5 the controller 80 performs a process related to warming up the cartridges. The process related to warming up makes the cartridges ready for use. The controller 80 may omit the process related to warming up depending on the specification of the image forming apparatus 1. The process related to warming up may also include a process of consuming the developers of the toner cartridges 30 and a process of rotating the photosensitive drums 21 which use the toner cartridges 30 or the drum cartridges 20.

After that, the controller 80 waits until a print instruction is received (S6: NO). In a case that the user instructs the image forming apparatus 1 to perform printing via the input portion, the controller 80 receives the print instruction. In a case that the controller 80 receives the print instruction (S6: YES), in S7 the controller 80 performs the printing process.

According to the process described above, the image forming apparatus 1 can start the attachment detection process using, as a trigger, a power on operation or an operation that the cover 11 is closed. Here, these operations are necessary for the operation of the image forming apparatus. Accordingly, the image forming apparatus 1 can detect the attachment of the new cartridges to the image forming apparatus 1 without omissions.

According to the process described above, the image forming apparatus 1 performs the new cartridge detection process during a period after the image forming apparatus 1 detects the attachment of the new cartridge to the main casing 10 (S2: YES) and before the image forming apparatus 1 performs the warm-up process (S5) or before the actual printing process (S7). In a case that the attached cartridge is a new cartridge, the image forming apparatus 1 can rewrite the usage status information to information indicating that the cartridge is an old cartridge.

In other words, the image forming apparatus 1 rewrites the usage status information stored in the memory of the cartridge during a period after the attachment of the new cartridge to the main casing 10 and before a material of the cartridge or a part of the cartridge is consumed. Therefore, even in a case that the material or the part of the cartridge is not consumed or worn immediately after the attachment, the image forming apparatus 1 can rewrite the usage status information of the new cartridge to information indicating the old cartridge.

In a conventional technique, a determination process of determining whether a cartridge is a new cartridge or an old cartridge is performed at a timing at which the cartridge is actually used. The image forming apparatus 1 according to the present embodiment can exhibit more advantageous effects than such a conventional technique.

For example, in the conventional technique, the timing at which a cartridge is opened and attached and the timing at which the cartridge is actually used may be different depending on the specifications of the image forming apparatus 1 and the cartridge. Specifically, for the image forming apparatus 1 which does not perform a warm-up operation immediately after the attachment of the cartridge, the above-described timing difference could occur.

For example, in a case that the warm-up operation or the actual printing operation is used as a trigger to perform the determination process to determine the cartridge is a new cartridge or an old cartridge, the image forming apparatus 1 rewrites the usage status information stored in the memory of the cartridge when the image forming apparatus 1 is in operation. Thus, a memory rewriting error could occur by vibrations caused by the operation of the image forming apparatus 1.

By contrast, the image forming apparatus 1 according to the present embodiment can accurately count the number of times a new cartridge is detected, regardless of the specifications of the image forming apparatus 1 and the cartridge.

There is a conventional technique in which a gear for detecting a new cartridge is provided in a drum cartridge or a toner cartridge. In this conventional technique, a new cartridge is detected by detecting a gear rotation, which is occurred in a case that the cartridge is a new cartridge, using a sensor or etc. The image forming apparatus 1 according to the present embodiment exhibits more advantageous effects than the known technique detecting the rotation of the gear by the sensor.

For example, in the conventional technique detecting the rotation of the gear by the sensor, an old drum cartridge or old toner cartridge can be detached from the image forming apparatus 1 and the gear of the cartridge which is once rotated can be reattached to the original position. In a case that the cartridge, to which the gear is reattached, is attached again to the image forming apparatus 1, the gear rotates again, and thus the image forming apparatus 1 recognizes that the cartridge attached again is a new cartridge.

By contrast, in the image forming apparatus 1 according to the present embodiment, the usage status information in a memory of a cartridge is rewritten in response to the detection of attachment of the cartridge. Accordingly, even in a case that the cartridge is attached again to the image forming apparatus 1, the image forming apparatus 1 does not double-count this cartridge as a new cartridge. Thus, the image forming apparatus 1 can accurately count the number of times a new cartridge is detected.

Management of New Cartridge Numbers in Server

The server 40 transmits a request for status data to the image forming apparatus 1 at a predetermined timing different from the timing at which the processes illustrated in FIGS. 3 and 4 are performed. Specifically, the server controller 43 generates the request for status data and transmits the request to the image forming apparatus 1 via the server communication portion 41. The communication portion 81 receives the request and outputs the request to the controller 80. In response to this request, the controller 80 reads the new cartridge detection numbers (the new drum cartridge detection number and the new toner cartridge detection number) from the main memory 15. The controller 80 transmits the status data including the read new cartridge detection numbers to the server 40 via the communication portion 81. In this manner, the controller 80 can perform a notification process notifying the server 40 of the new cartridge detection numbers.

The server communication portion 41 receives the status data and outputs the status data to the server controller 43. The server controller 43 stores the received status data in a storage region of the server memory 42. This storage region is for the printer information corresponding to the printer ID included in the status data. In this manner, the server 40 can manage the new cartridge detection numbers for each image forming apparatus 1.

Second Embodiment

Another embodiment of the present disclosure will be described below. For convenience of description, members having the same functions as those described in the first embodiment will be denoted by the same reference signs, and the description thereof will be omitted.

The image forming apparatus 1 may be an inkjet printer. In a case that the image forming apparatus 1 is the inkjet printer, ink cartridges are attached to the respective cartridge holders 13, instead of the drum cartridges 20 and the toner cartridges 30 described in the first embodiment. There is no particular limitation on the number of ink cartridges attached to the image forming apparatus 1. For example, a total of four ink cartridges accommodating developers of four colors, e.g., cyan, magenta, yellow, and black, may be attached to the image forming apparatus 1.

Each ink cartridge includes an ink memory. The ink memory stores an ink ID, ink life information, and ink usage status information as an example of the usage status information, for example. In the present embodiment, the ink ID and the ink life information are not necessary. The ink usage status information indicates whether the ink cartridge is a new cartridge or an old cartridge indicating a used product. The "used product" includes an ink cartridge that is not new and is still in use with ink remaining in the ink cartridge.

In a case that the image forming apparatus 1 is the inkjet printer and transmits a new cartridge detection number to the server 40, the main memory 15 stores a new ink cartridge detection number. In the present embodiment, the main memory 15 may not store the new drum cartridge detection number or the new toner cartridge detection number.

In a case that the image forming apparatus 1 is the inkjet printer, the processing flows illustrated in FIGS. 3 and 4 are executed similarly. Specifically, in a case that the image forming apparatus 1 is the inkjet printer, the drum cartridge 20 or the toner cartridge 30 in FIGS. 3 and 4 may be read as the ink cartridge. Further, in a case that the image forming apparatus 1 is the inkjet printer, the drum memory 22 or the toner memory 32 in FIGS. 3 and 4 may be read as the ink memory. Further, in a case that the image forming apparatus 1 is the inkjet printer, the drum usage status information and the toner usage status information in FIGS. 3 and 4 may be read as the ink usage status information. Further, in a case that the image forming apparatus 1 is the inkjet printer, the new drum cartridge detection number and the new toner cartridge detection number in FIGS. 3 and 4 may be read as the new ink cartridge detection number. The image forming apparatus 1 according to the present embodiment also exhibits similar effects to those of the image forming apparatus 1 according to the first embodiment.

First Modification

In response to a request from the server 40, the controller 80 according to the first and second embodiments may transmit a notification indicating that a new cartridge is detected, instead of notifying the server 40 of a value of the new cartridge detection number. In a case that the controller 80 transmits the notification indicating that a new cartridge is detected and detects a plurality of new cartridges in the new cartridge detection process illustrated in FIG. 4, the controller 80 notifies the server 40 of the number of new detected cartridges. In this manner, the controller 80 can notify the server 40 that the new cartridges are detected.

Second Modification

The controller 80 according to the first and second embodiments may transmit the new cartridge detection number (or the notification indicating that a new cartridge is detected) to the server 40 when the new cartridge detection number is incremented or the new cartridge detection process is completed for all the cartridges. In a case that the controller 80 transmits the new cartridge detection number or the notification when the new cartridge detection process is completed for all the cartridges, the server controller 43 may not generate the request for status data. The server communication portion 41 may not transmit the request.

Example of Implementation by Software

The controlling blocks of the image forming apparatus 1 and the server may be implemented by a logic circuit (hardware) formed with an integrated circuit (IC chip) and etc, or implemented by software.

In the latter case, each of the image forming apparatus 1 and the server 40 includes a computer executing, as software, instructions of a program that implement a corresponding function. For example, the computer includes at least one processor and a computer-readable storage medium storing the program. In the computer, the processor reads the program from the storage medium and executes the program, thereby achieving the object of the present disclosure. As the processor, the computer may use a CPU, for example. As the storage medium, the computer may use a "non-transitory tangible medium" such as a ROM (Read Only Memory), a tape, a disk, a card, a semiconductor memory, or a programmable logic circuit. The computer may also include a RAM (Random Access Memory) to develop the program therein. The program may be supplied to the computer via any transmission medium (e.g., a communication network or a broadcast wave) capable of transmitting the program. An aspect of the present disclosure may be implemented in the form of a data signal embedded in a carrier wave by which the control program is embodied according to electrical transmission.

While the disclosure has been described in detail with reference to the specific embodiment thereof, it would be apparent to those skilled in the art that various changes and modifications may be made therein without departing from the scope of the invention.

What is claimed is:

1. An image forming apparatus comprising:

a main casing having an opening through which a cartridge is to be attached, the cartridge including a material or a part to be used for performing image formation, and the cartridge further including a first memory configured to store usage status information indicating whether the cartridge is a new cartridge or an old cartridge which indicates a used product;

a cover movable between a first position at which the opening is opened and a close position at which the opening is closed;

a second memory configured to store, as a new cartridge detection number, a number of times a different cartridge is attached to the main casing; and a controller configured to perform a process related to the image formation, the controller being configured to perform:

an attachment detection process to detect that the cartridge is attached to the main casing;

a reading process to read the usage status information stored in the first memory of the cartridge attached to the main casing in a case that attachment of the cartridge to the main casing is detected in the attachment detection process;

a determination process to determine, based on the usage status information read in the reading process, whether the cartridge attached to the main casing is the new cartridge or the old cartridge;

a rewriting process to rewrite the usage status information to information indicating that the cartridge is the old cartridge in a case that the cartridge attached to the main casing is determined to be the new cartridge in the determination process;

an updating process to increment the new cartridge detection number stored in the second memory after the rewriting process; and a warm-up process to consume the material or the part of the cartridge, thereby making the cartridge ready for use, wherein the rewriting process is performed before the controller receives a print instruction and before the material or the part of the cartridge is consumed, wherein the rewriting process is performed before the warm-up process is performed.

2. The image forming apparatus according to claim 1, further comprising a communication portion configured to communicate with a management apparatus, wherein the controller is configured to perform:

a notification process to notify the management apparatus via the communication portion that the new cartridge is detected in response to a request from the management apparatus after the rewriting process.

3. The image forming apparatus according to claim 2, wherein the second memory comprises a main memory of the image forming apparatus, and wherein the notification process notifies, in response to a request from the management apparatus, the management apparatus of the new cartridge detection number via the communication portion.

4. The image forming apparatus according to claim 1, wherein the controller performs the attachment detection process triggered by powering on the image forming apparatus or closing the opening by the cover.

5. A controlling method for controlling an image forming apparatus, the controlling method comprising:

a reading step to read, in response to attachment of a cartridge including a material or a part to be used for performing image formation to a main casing of the image forming apparatus, usage status information stored in a first memory of the cartridge attached to the main casing, the usage status information indicating whether the cartridge is a new cartridge or an old cartridge which indicates a used product;

a determination step to determine, based on the usage status information read in the reading process, whether the cartridge attached to the main casing is the new cartridge or the old cartridge;

a rewriting step to rewrite the usage status information to information indicating that the cartridge is the old cartridge in a case that the cartridge attached to the main casing is determined to be the new cartridge in the determination step; and a warm-up step to consume the material or the part of the cartridge, thereby making the cartridge ready for use, wherein the rewriting step is performed before the image forming apparatus receives a print instruction and before the material or the part of the cartridge is consumed, wherein the rewriting step is performed before the warm-up step is performed.

* * * * *